United States Patent [19]

Standke

[11] Patent Number: 4,867,704

[45] Date of Patent: Sep. 19, 1989

[54] FIXTURE FOR COUPLING COAXIAL CONNECTORS TO STRIPLINE CIRCUITS

[75] Inventor: Randy E. Standke, Canoga Park, Calif.

[73] Assignee: Hughes Aircraft Company, Los Angeles, Calif.

[21] Appl. No.: 229,881

[22] Filed: Aug. 8, 1988

[51] Int. Cl.[4] ..... H01R 17/04
[52] U.S. Cl. ..... 439/581
[58] Field of Search ..... 439/63, 581

[56] References Cited

U.S. PATENT DOCUMENTS

| | | | |
|---|---|---|---|
| 3,622,915 | 11/1971 | Davo | 439/581 |
| 4,724,409 | 2/1988 | Lehman | 439/581 |
| 4,801,269 | 1/1989 | Howard et al. | 439/581 |

*Primary Examiner*—Joseph H. McGlynn
*Attorney, Agent, or Firm*—Michael W. Sales; Wanda Denson-Low

[57] ABSTRACT

A stripline launcher for making high quality transitions between an SMA connector 18 and a stripline circuit 54. A pair of metallic blocks 42, 44 include tapered surfaces 46, 50 which serve as ground planes that make a gradual transition to the small ground plane spacing of the stripline circuit 54 which is compatible with the dimensions of the larger connector 18.

18 Claims, 3 Drawing Sheets

FIXTURE FOR COUPLING COAXIAL CONNECTORS TO STRIPLINE CIRCUITS

BACKGROUND OF THE INVENTION

1. Technical Field

This invention relates to electrical connectors and, more particularly, for a fixture used to interconnect coaxial cable connectors to stripline circuits.

2. Discussion

The present invention finds particular utility for transmitting high frequency signals, in particular signals having frequencies of 3 GHz and above. This range is often referred to generally as the microwave frequency range. It is well known that special precautions must be taken when dealing with signal transmission circuits in this frequency range. Otherwise unwanted transmission losses, reflections and other undesirable characteristics can result.

Microwave signals are often carried on shielded coaxial cables. These cables are typically used to transmit microwave signals to and from various end devices. Many of these end devices require that connections to them are made by way of flat or "stripline" conductors residing on a surface of a dielectric board (hereinafte "a stripline circuit"). Examples of such devices include power splitters, mixers, hybrid couplers, directional couplers, filters, attenuators, phase shifters, antenna elements and antenna arrays.

The stripline conductors are sandwiched between two ground planes. The purpose of the ground planes is to provide the outer grounding surfaces above and below the center conductor in the same way that the outer conductor of a coaxial transmission line surrounds the center conductor. Stripline may be thought of as a flattened form of coaxial cable. Since the electrical fields around the center conductor only extend a short distance to either side, conductors are not required to the sides of a stripline circuit. In some applications it is desirablle to reduce the ground plane spacing as much as possible because space limitations may require the use of smaller circuits.

Female coaxial connectors such as SMA, standing for Sub-Miniature Series A (military designation) connectors, are often used to couple the coaxial cable to the stripline conductors. SMA connectors are well known in the art and they generally include a center pin having a tab on its inner end and a female recess on its opposite end. The center pin is surrounded by a Teflon insulator which serves to support the center pin in the outer housing. The housing acts as the outer coaxial conductor around the center pin.

It is fairly easy to make high quality transitions between SMA connectors and stripline circuits when the ground plane spacing of the stripline circuit and diameter of outer conductor of the SMA connector are essentially the same. However, when the stripline circuit ground plane spacing decreases below about 0.060 inch that certain heretofore unresolved problems result. These problems include providing electrical and mechanical connections between the connector housing and the stripline ground planes, as well as between the connector center pin tab and the stripline conductor. Other problems include compensating for the large electrical discontinuities created by the dimensional differences.

The present invention is directed to solving one or more of these problems.

SUMMARY OF THE INVENTION

The present invention provides a well matched transition between coaxial cable connectors and stripline circuits with small ground plane spacings. A fixture made in accordance with the teachings of this invention utilizes a construction that gradually tapers the effective ground plane spacing from the large connector spacing to the small stripline circuit ground plane spacing. Thus, abrupt changes in the characteristics of the transmission path are avoided thereby greatly reducing the electrical dscontinuities to be compensated while permitting extremely small ground plane spacings.

In the preferred embodiment the fixture includes two metallic blocks which sandwich the stripline circuit boards therebetween. The surfaces of the two blocks are gradually tapered from an end of the fixture where the connector is mounted down to the small ground planes provided on the boards. As a result, the tapered surfaces of the blocks act as transitional ground planes that avoid abrupt differences in the mechanical and electrical qualities between the connector and the stripline circuit.

BRIEF DESCRIPTION OF THE DRAWINGS

The various advantages of the present invention will become apparent to those skilled in the art upon reading the following specification and by reference to the drawings in which.

DESCRIPTION OF THE PREFERRED EMBODIMENT

Turning now to the drawings, fixture 10 is illustrated as coupling high frequency signals between a coaxial cable 12 and an end device 14. End device 14 can be a variety of other high frequency devices such as power splitters, hybrid couplers, directional couplers and phase shifters. It should also be understood from the outset that fixture 10 is shown in its most simple form, i.e, with one end device 14 and one cable 12. However, it should be understood that the teachings of this invention are applicable to a fixture which would accommodate a much larger number of connections. In addition, the specifically disclosed male/female positions can be reversed if desired.

Figure 2:
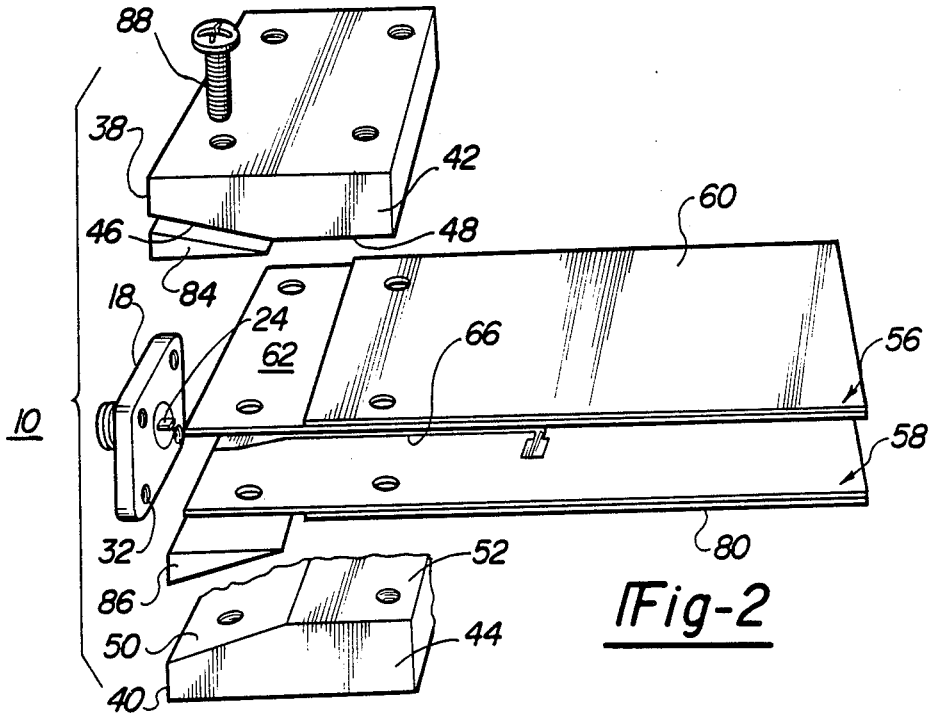
FIG. 2 is an exploded perspective view of the fixture of FIG. 1 with parts broken away.

Cable 12 includes a conventional male end connector 16 which includes a shielded male pin (not shown) extending therefrom. The male connector 16 mates with a conventional SMA or other female connector 18. As perhaps shown best in FIGS. 2 and 5, connector 18 includes a conductive center pin 20 having a recess 22 in its outer end for receiving the male pin of connector 16. The opposite end of pin 20 terminates in a flat tab 24. A housing 26 for the connector 18 includes threads 28 on its outer end that engage inner threads (not shown) on male connector 16. The opposite end of housing 26 terminates in a flat plate 30 having a plurality of mounting holes 32 therein for accommodating fasteners 34 for mounting the connector. An insulator 35 made of dielectric material such as Teflon surrounds the pin 20 and maintains is spacing with respect to the surrounding inner surface 36 of the housing which serves as the coaxial outer conductor. By way of a specific example, the diameter of pin 20 is about 0.05 inch and the inner diameter of housing surface 36 is about 0.162 inch. The length of tab 24 is about 0.05 inch; its width is about 0.05 inch.

Connector 18 is mounted to end faces 38 and 40 of upper and lower rectangular blocks 42 and 44, resectively. Blocks 42 and 44 are solid pieces of aluminum although other electrically conductive material such as brass could also be used. The lower surface of block 42 includes a tapered face 46 that begins adjacent the connector 18 and then tapers linearly downwardly until it meets a generally flat face 48. Similarly, the upper surface of the lower block 44 includes a tapered face 50 and a flat face 52.

A stripline circuit generally designated by the numeral 54 is defined by a pair of thin sheets or boards 56 and 58. The bodies of boards 56 are made of suitable insulating material. In this embodiment the boards are about 0.015 inch thick. The upper surface of board 56 has a metallic layer 60 that covers substantially the entire surface thereof except for the leftmost region 62. Region 62 corresponds in dimension to the length of tapered face 46. As will appear, metallic later 60 and tapered face 46 cooperate to provide a continuous ground plane for the stripline conductor of the fixture. Metallic layer 60 is made of copper and is about 0.0007 inch thick (shown exaggerated in the drawings for clarity). The lower surface of board 56 is completely free of metal.

Figure 3:
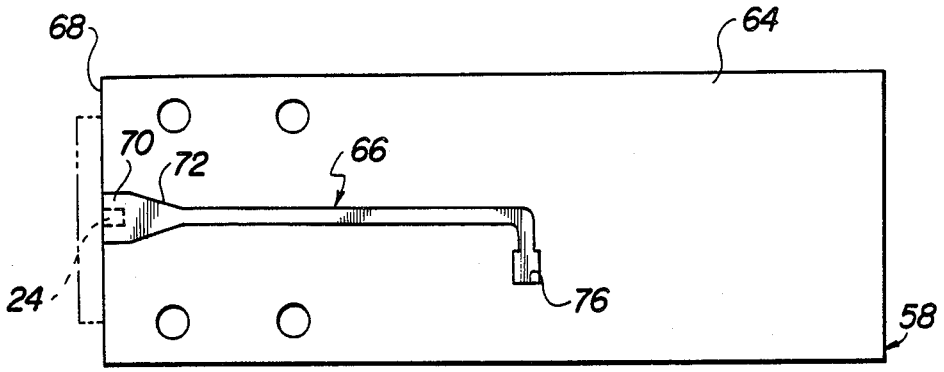
FIG. 3 is a plan view of a upper surface of the lower board which illustrates a stripline conductor configuration.

The upper surface 64 of board 58 is shown in FIG. 3. Surface 64 has a metallic stripline conductor 66 formed thereon. The end 70 of conductor 66 terminates adjacent to an edge 68 of board 58. This conductor end makes the electrical connection with the tab 24 of the connector 18. Tab 24 is shown in dotted lines in FIG. 3. To maintain the standard 50 ohm characteristic impedance, the strip conductor 66 is also tapered from an initial width of 0.105 inch (which extends about 0.05 inch from edge 68), the taper 72 then linearly reducing to a width of 0.02 inch over a 0.450 inch region. It should be noted that the stripline conductor 66, after being tapered down, can take a wide variety of configurations depending upon the end use. In FIG. 3, the conductor 66 terminates in a pad 76 which is electromagntically coupled to device 14 via a slotline connection (not shown).

Figure 4:
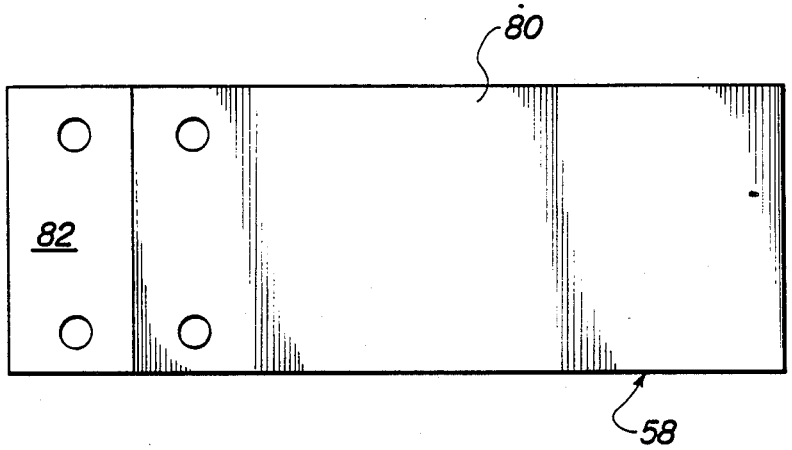
FIG. 4 is a plan view of an opposite side of the board shown in FIG. 3.

The lower surface of board 58 is shown in FIG. 4.

It is substantially the same as the upper surface of board 56 in that it includes a ground plane layer 80 on most of its surface except for region 82 corresponding to the tapered face 50 of lower block 44.

A wedge-shaped insulator 84 is spaced between the metal free board region 62 and the tapered face 46 of block 42. Similarly, insulator wedge 86 is located between lower board region 82 and the lower tapered face 50 of block 44. The purpose of insulator wedges 84 and 86 is to provide a continuous, linearly changing dielectric fill between the ground planes in the tapered region. Also, they provide the mechanical support to press the boards 56, 58 together to press pin 24 tightly against the stripline conductor 70. In the preferred embodiment, wedges are made of Teflon although other suitable insulator materials such as Teflon-fiberglass compositions could also be used.

Figure 1:
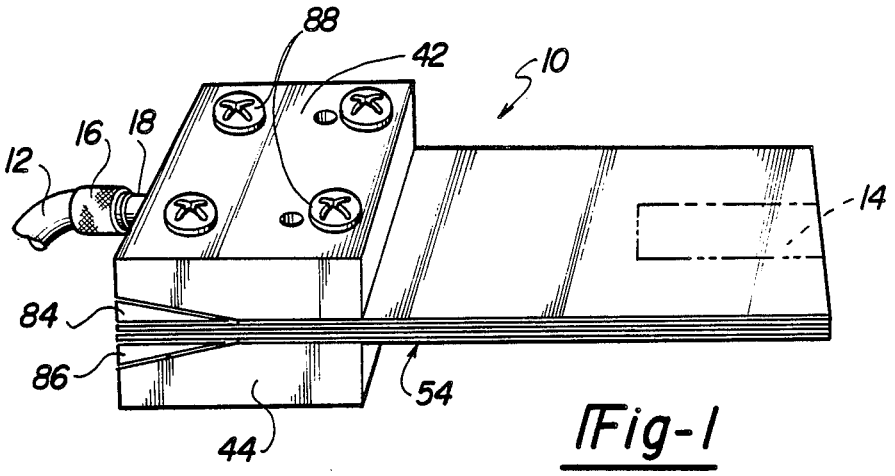
FIG. 1 is a perspective view of a fixture made in accordance with the teachings of the present invention.
Figure 5:
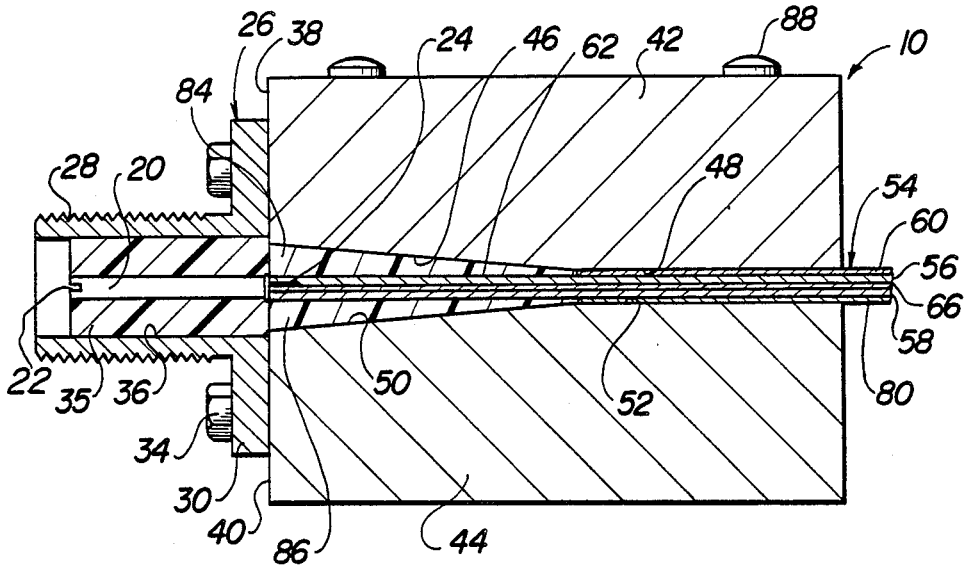
FIG. 5 is a cross sectional view of the fixture.

The various components thus far described are all sandwiched together as best shown in FIGS. 1 and 5. The components are held in place by a plurality of fasteners 88 which pass through the components from the upper block 42 to the lower block 44. As best shown in FIG. 5, the tab 24 of the connector 18 is pressed between boards 56 and 58 and thus make electrical connection to the end portion 70 of the stripline conductor 66 and is preferably soldered thereto. The width of the strip end portion 70 is preferably held constant over the first 0.05 inch of its length to compensate for the junction capacitance between the stripline conductor 66 and the SMA connector 18. As noted above, the tapered surfaces 46 and 50 of blocks 42 and 44 initially serve as ground planes for the stripline conductor 66. The ground plane spacing provided thereby begins with a spacing of about 0.137 inch, i.e., the distance between surfaces 46 and 50 at the end 38, 40 of the fixture adjacent the connector 18. This 0.137 inch distance is the approximate ground plane spacing which would produce a 50 ohm characteristic impedance if the 0.05 inch diameter center conductor 20 were to have continued beyond the connector body. This ground plane spacing is therefore chosen to minimize the junction reactance, which in general may be capacitive or inductive. In this case, it is slightly capacitive, and is compensated by the end portion 70 of stripline conductor 66. The ground place spacing provided by tapered faces 46 and 50 is then linearly reduced to 0.030 inch over a relatively long distance of 0.500 inch. This much smaller ground plane spacing corresponds with the spacing of metallic layers 60 and 80 which serve to provide the ground planes for the remaining portion of the stripline circuit 54.

Thus, it can be appreciated that the fixture 10 of the present invention provides a high quality transition between SMA connectors and stripline circuits having extremely small ground plane spacings. Because there are no abrupt changes in ground plane spacing between the connector construction and the stripline circuit, the undesirable problems associated with earlier designs have been substantially avoided. It should be understood that while this invention has been described in connection with a particular example thereof that it is not so limited because the skilled practitioner will realize that other modifications can be readily made after have the benefit of studying the specification, drawings and following claims. In particular, the ground plane spacing can be reduced to much less than 0.030 inch. The minimum ground plane spacing achievable is only limited by the degree to which the physical dimensions of the materials can be controlled.

What is claimed is:

1. A fixture for coupling high frequency signals between a coaxial cable connector and a stripline circuit, the cable connector having a center pin terminating in a tab and surrounded by a conductive housing, the stripline circuit having a flat conductor lying between metallic ground planes of smaller spacing than the spacing between the conductor center pin and the housing, said fixture comprising:

an upper metallic block having a first end, an opposite second end, a pair of sides, an upper surface and a lower surface; said lower surface having a flat face and a tapered face converging from said first end to the flat face;

a lower metallic block having a first end, an opposite second end, a pair of sides, a lower surface and an upper surface; said upper surface having a flat face and a tapered face converging from said first end to the flat face; and means for sandwiching the stripline circuit between the upper and lower blocks such that the tapered faces thereof provide transitional ground planes to the smaller stripline circuit ground plane spacing.

2. The fixture of claim 1 which further comprises:

an upper board having an upper major surface and a lower major surface;

a lower board having an upper surface and a lower surface;

said stripline conductor being formed on the upper surface of the lower board, said conductor having an end portion which terminates adjacent to the first end of the blocks; and the upper surface of the upper board and the lower surface of the lower board each having metallic layers thereon which terminate at the intersection between the flat and tapered faces of the upper and lower blocks, respectively.

3. The fixture of claim 2 which further comprises:

first and second wedge-shaped insulator members, the first insulator member being located between the upper surface of the upper board and the tapered face of the upper block; and the second insulator member being located between the upper surface of the lower board and the tapered face of the lower block.

4. The fixture of claim 3 wherein the tab of the connector is pressed ont an end portion of the stripline conductor.

5. The fixture of claim 4 wherein the end portion of the stripline conductor is wider than the tab for a given distance and then tapers downwardly to a preselected width to thereby maintain a substantially constant characteristic impedance.

6. The fixture of claim 1 wherein said connetor is an SMA connector.

7. The fixture of claim 1 wherein said upper and lower blocks are each integral pieces of metal.

8. The fixture of claim 2 wherein said upper and lower boards extend beyond said second ends of the blocks, with the stripline conductor being connected to an external device mounted thereon.

9. The fixture of claim 4 wherein fasteners extending through the upper and lower blocks are used to sandwich the boards, wedge insulators, and connector tab together.

10. A fixture for coupling an SMA connector to a stripline circuit, said fixture comprising:

a first board having a stripline conductor having an end portion terminating adjacent one edge of the board on one surface thereof, the opposite surface of the board having a metallic ground plane coating thereon except for a first region adjacent said edge;

a second substantially coextensive board lying on the first board, a lower surface of the second board being substantially free from metal while the upper surface has a metallic ground plane coating thereon except for a second region adjacent an edge of the second board;

a first wedge-shaped insulator member adjacent to the first region on the first board;

a second wedge-shaped insulator member adjacent the second region on the second board;

a first metallic block having an end and a tapered surface converging therefrom meeting a generally flat face, the tapered surface lying over the first wedge and providing a ground plane for the stripline conductor over a portion of the length of the block, with the metallic coating on the first board providing a ground plane throughout the remaining length of the block;

a second block member having an end and a tapered surface converging therefrom to a flat face, the tapered surface lying under the second wedge and providing a second ground plane for the stripline conductor for a portion of the length of the block, with the metallic coating on the second board providing another ground plane for the remaining length of the block; and said SMA connector having an inner tab connected to said stripline conductor at said end thereof whereby the tapered surfaces of the blocks provide transitional ground planes to the relatively small stripline circuit ground plane spacing provided by the coatings on the boards.

11. The fixture of claim 10 wherein the insulators are Teflon.

12. The fixture of claim 10 wherein an inner end of the SMA connector is in the form of a flat tab having a given width, and wherein said end of the stripline conductor is wider than the tab for a given distance and then the stripline conductor tapers downwardly to a preselected width to thereby maintain a substantially constant characteristic impedance.

13. The fixture of claim 10 wherein said blocks are made of aluminum.

14. The fixture of claim 10 wherein a plurality of fasteners extending from the first block to the second block are used to sandwich the boards, insulators and connector tab together.

15. The fixture of claim 10 wherein the ground plane spacing provided between the metallic coatings on the boards is less than 0.060 inch.

16. A method of making an electrical coupling between a coaxial cable connector and a stripline circuit having a ground plane smaller spacing, said method comprising:

mounting the connector to one end of a fixture;

sandwiching the stripline circuit between metallic opposing members of a fixture; and using portions of said opposing members to provide for transitional ground planes from the connector to the stripline circuit.

17. The method of claim 16 wherein said transitional ground planes are provided by tapered surfaces in said members which converge from a end of the fixture to which the connector is mounted down to the smaller ground planes for the stripline circuit.

18. The method of claim 17 wherein said smaller ground planes for the stripline circuit are provided by metallic coatings on opposite surfaces of insulating boards, one board carrying a conductor on its other surface.

* * * * *